US006418566B1

(12) United States Patent
Plonta

(10) Patent No.: US 6,418,566 B1
(45) Date of Patent: Jul. 16, 2002

(54) TOILET SEAT LIFT KIT

(76) Inventor: Duane Plonta, 4330 Farver Rd., Gagetown, MI (US) 48735

( * ) Notice: Subject to any disclaimer, the term of this patent is extended or adjusted under 35 U.S.C. 154(b) by 0 days.

(21) Appl. No.: 09/732,058

(22) Filed: Dec. 7, 2000

(51) Int. Cl.[7] ..... A47K 13/00
(52) U.S. Cl. ..... 4/239; 4/237; 4/240; 4/DIG. 5
(58) Field of Search ..... 4/237, 239, 240, 4/235, DIG. 5, 254, 248, 236

(56) References Cited

U.S. PATENT DOCUMENTS 1,041,342 A * 10/1912 Pfau
1,158,039 A * 10/1915 Florey
1,494,341 A * 5/1924 Cowan
1,682,799 A * 9/1928 Richards
1,839,207 A * 1/1932 Dreisbach
2,050,472 A * 8/1936 Steadman
2,109,829 A * 3/1938 Roe
2,980,922 A * 4/1961 Taylor
3,557,393 A * 1/1971 Waldom
4,213,211 A * 7/1980 Bemis et al.
4,893,360 A * 1/1990 Wofford
5,091,999 A * 3/1992 Turner, Jr.
5,251,338 A * 10/1993 Light
5,361,425 A * 11/1994 Armanno, Sr.
5,379,465 A * 1/1995 Vaughn
5,920,917 A * 7/1999 Landsberger

OTHER PUBLICATIONS

Journal of A.M.A., Oct. 18, 1958, vol. 186, No. 7, p. 930.*

* cited by examiner

*Primary Examiner*—Timothy L. Maust
*Assistant Examiner*—Khoa Huynh
(74) *Attorney, Agent, or Firm*—Reising, Ethington, Barnes, Kisselle, Learman & McCulloch, P.C.

(57) ABSTRACT

The toilet seat lift kit has a toilet seat mounting lift block, three lift blocks, two elongate bolts and fasteners for the lift blocks. The elongated bolts clamp a seat mounting assembly, and a toilet seat mounting lift block to the bowl rim of the toilet fixture. The toilet seat is fixed to the seat mounting assembly and is pivotal about a toilet seat horizontal axis of the seat mounting assembly. Two lift blocks are attached to the bottom surface of the toilet seat. When the two lift blocks set on the bowl rim, the toilet seat is supported in a generally horizontal position. A third lift block can be attached to front portion of the toilet seat to support the seat and to function as a spray guard. Recesses on the top of the lift blocks provide space for pads on the bottom surface of the toilet seat.

3 Claims, 2 Drawing Sheets

TOILET SEAT LIFT KIT

TECHNICAL FIELD

This invention relates to a toilet seat and more particularly to a kit for raising a toilet seat to a higher elevation for use by physically challenged individuals and others who would prefer to use a toilet seat that is elevated from the usual position.

BACKGROUND OF THE INVENTION

The toilet seat for most toilets used in North America is pivotally secured to the upper portion of a porcelain toilet fixture. The upper surface of the porcelain fixture is generally about 14 inches high. The upper surface of the seat is contoured for comfort and is generally about ½ inch to 2 inches above the upper surface of the porcelain fixture. At this height individuals with short stature can use a toilet seat comfortably. Individuals with a relatively tall stature can also use the toilet seats that are about sixteen inches above the floor with minimal discomfort.

Individuals that are physically challenged can find it difficult to sit on any seat that is only about sixteen inches from the floor and to stand up after sitting on such a seat. The current solution to the problem is to replace the porcelain fixture portion of the toilet with a higher porcelain unit. The higher porcelain toilets are relatively expensive and are at best difficult for short people to use.

The employment of porcelain toilet fixtures of different vertical heights is acceptable in public facilities that require multiple toilet fixtures. Such employment is not acceptable in homes. This is particularly true where the need for a toilet with a higher toilet seat is temporary. An adult with a foot, leg or hip injury for example can likely sit and rise to a standing position from a toilet seat that is about eighteen inches high but may have difficulty and possibly require assistance to rise from a toilet seat that is under about sixteen inches high. In general, the higher a seat is the less effort that is required to move off the seat and into a standing position. However, the height of a seat makes it difficult for individuals with short stature to lift themselves up onto the seat. If the height of the seat is raised, more people with short stature will have difficulty lifting themselves up onto the seat.

SUMMARY OF THE INVENTION

An object of the invention is to provide a raised toilet seat on an existing toilet fixture. Another object of the invention is to provide a kit for raising the seat of a toilet for use by individuals that require a higher seat. A further object of the invention is to provide a kit for raising the height of a toilet seat that is removable to lower the toilet seat to a lower position.

Toilet seats are pivotally attached to a seat mounting assembly that permits pivotal movement of the seat about a toilet seat horizontal axis relative to a toilet fixture. The mounting assembly is attached to the porcelain fixture by two bolts that pass through two spaced apart vertical seat mounting passages in the upper rear portion of the toilet fixture. The space between the two vertical passages and the diameter of the two passages in the porcelain toilet fixture is generally the same for most toilet fixtures made in North America.

A toilet seat mounting lift block with the desired height has two spaced apart vertical passages that can be aligned with the seat mounting passages in the toilet fixture. Long bolts pass through apertures in the mounting assembly, passages in the toilet seat mounting lift block, through seat mounting passages in the toilet fixture and are tightened to clamp the seat mounting assembly and the seat mounting lift block to the toilet fixture. A toilet seat support block is secured to a bottom surface of the toilet seat in a position spaced from the toilet seat horizontal axis. The seat support block is preferably secured to the seat by fasteners that permit removal of the seat support block. The seat support block contacts the toilet fixture and holds the toilet seat in a generally horizontal use position when in contact with the toilet fixtures.

After the need for a raised toilet seat ceases, the toilet seat support block is removed from the toilet seat, the toilet seat mounting lift block is removed and the toilet seat is again secured to the toilet fixture in its original lowered position.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
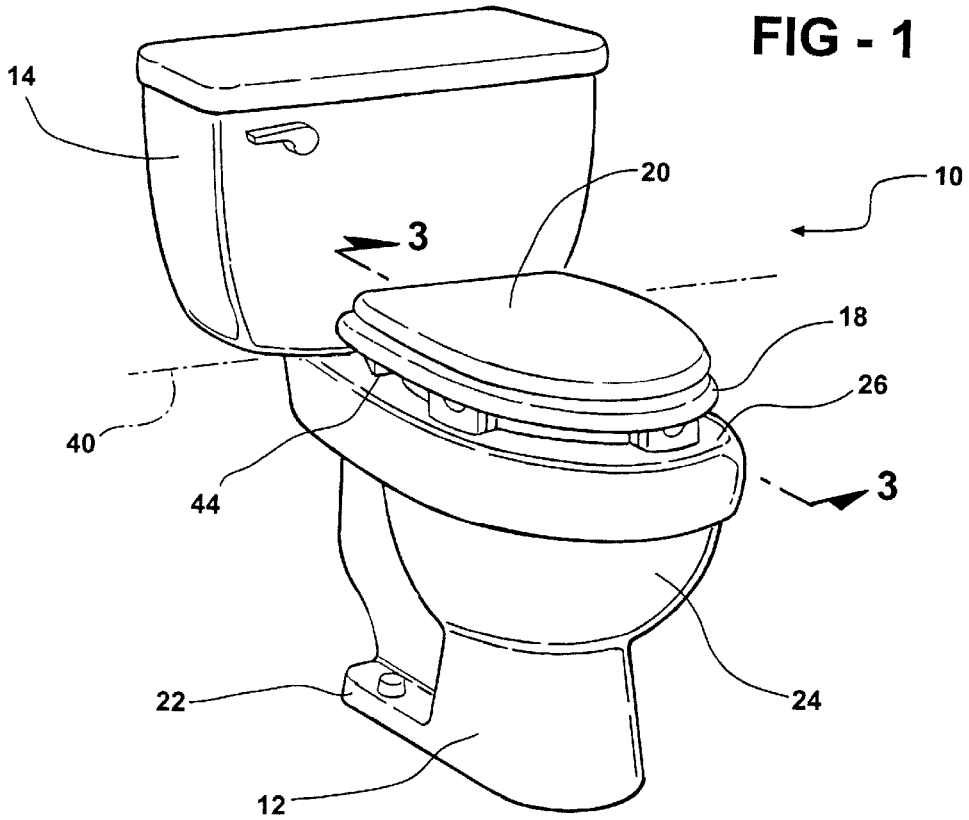
FIG. 1 is a perspective view of a toilet with the seat raised by the toilet seat lift kit.
Figure 3:
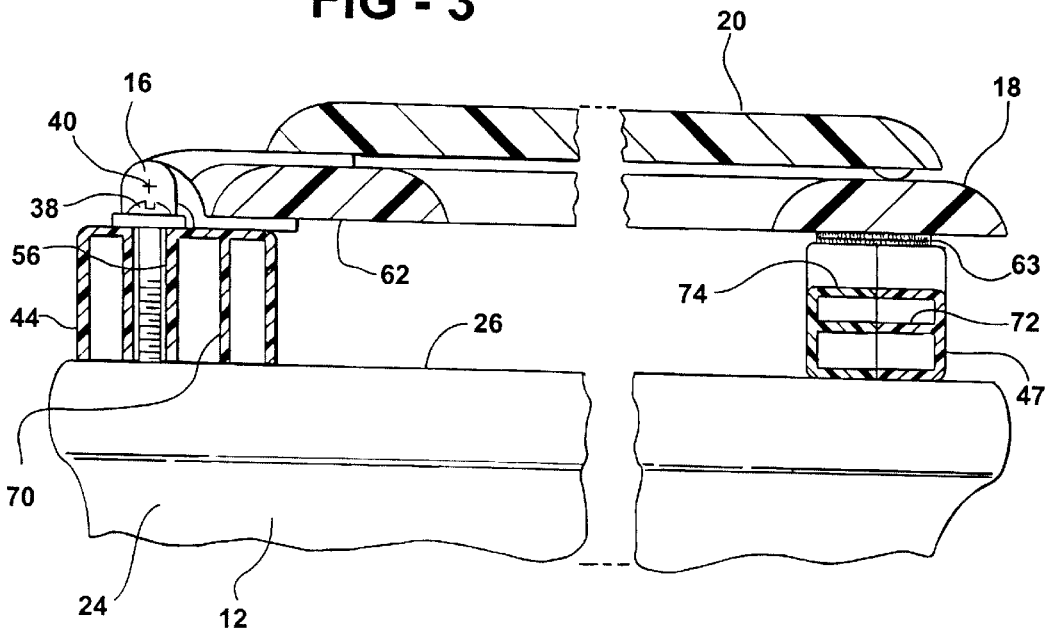
FIG. 3 is an enlarged sectional view taken along line 3—3 in FIG. 1.
Figure 2:
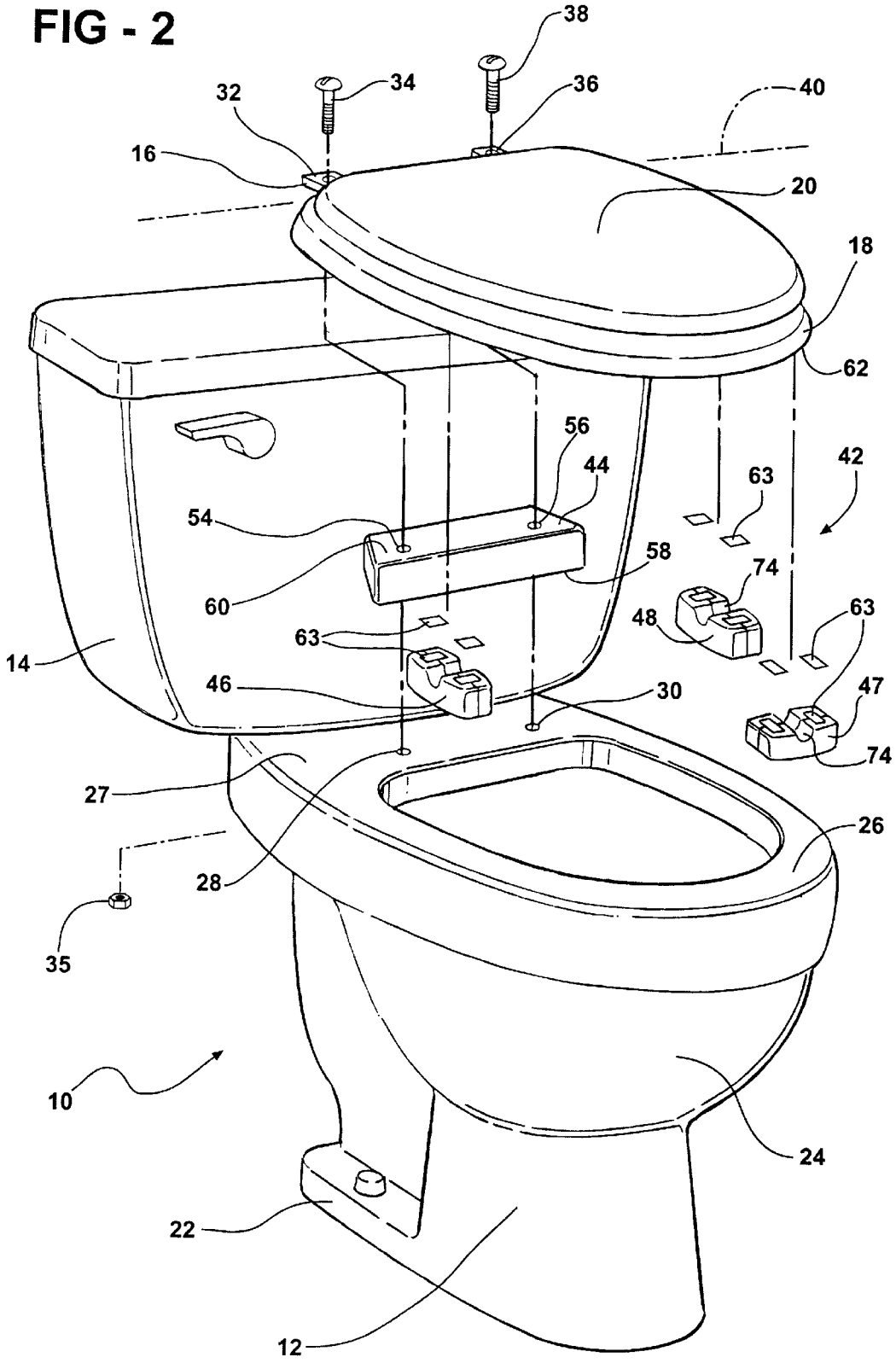
FIG. 2 is an expanded perspective view of a toilet fixture, a toilet seat and the toilet seat lift kit.

The toilet 10, shown in FIGS. 1 and 2 includes a porcelain toilet fixture 12, a water tank 14, a seat mounting assembly 16, a seat 18 and a toilet seat cover 20. The porcelain toilet fixture 12 has a base 22 that is anchored to a floor. A bowl portion 24, a bowl rim 26, a water tank support 27 and two space apart vertical seat mounting passages 28 and 30. The water tank 14 is clamped to the tank support 27 to the rear of the bowl rim 26.

The seat mounting assembly 16 includes a left bracket 32 that is clamped to the toilet fixture 12 by a bolt 34 that passes through the vertical seat mounting passage 28 and a right bracket 36 that is clamped to the toilet fixture by a bolt 38 that passes through the vertical mounting passage 30. The left bracket 32 and the right bracket 36 provide a toilet seat horizontal pivot axis 40.

A toilet seat 18 is pivotally secured to the set a mounting assembly 16 for pivotal movement about the toilet seat horizontal axis 40. A toilet seat cover 20 is also pivotally secured to the seat mounting assembly 16 for pivotal movement about the toilet seat horizontal axis 40. However it should be noted that the toilet seat covers 20 are not always used with toilet seats 18 and that the seat covers are optional.

The toilet seat lift kit 42 includes a toilet seat mounting lift block 44, three toilet seat lift blocks 46, 47 and 48 and two long bolts 34 and 38 that replace the original short bolts. The toilet seat mounting lift block 44 is a generally rectangular block of a high density rigid plastic material. Two vertical seat mounting passages 54 and 56 pass through the mounting lift block 44. The seat mounting passages 54 and 56 are spaced apart the same distance as the vertical seat mounting passages 28 and 30 in the toilet fixture 12. The bottom surface 58 of the seat mounting lift block 44 covers and contacts substantially all of the upwardly facing surface of the toilet fixture 12 between the water tank 14 and the inside of the bowl portion 24 to provide maximum stability for the mounting lift block. The height of the mounting lift block 44 from the bottom surface 58 to the top surface 60 corresponds to the height that the toilet seat 18 is to be raised. The mounting lift block 44 can easily lift the toilet seat 18 from two to four inches.

The two toilet seat lift blocks 46 and 48 are attached to a bottom surface 62 of the toilet seat 18. One of the lift blocks 46 and 48 is positioned on each side of the toilet seat 18 and well forward of the mounting lift block 44. The vertical thickness of each of the lift blocks 46, 47 and 48 is substantially the same as the height of the mounting lift block 44 from the bottom surface 58 to the top surface 60. By making the mounting lift block 44 and the lift blocks 46, 47 and 48 the same height, the toilet seat 18 is generally horizontal when the lift blocks 46, 47 and 48 are setting on top of the bowl rim 26. The lift blocks 46, 47 and 48 are preferably attached to the toilet seat 18 by a fastener system that provides quick and easy removal. The fastener system may include mechanical fasteners such as screws, bolts, hook and loop fasteners 63, or magnetic members. If quick removal is not required, the lift blocks 46, 47 and 48 can be glued to the toilet seat 18. The number, size and shape of the lift blocks 46, 47 and 48 can be modified.

Toilet seat lift kits 42 are installed by removing the short bolts and removing the seat mounting assembly 16 together with the seat 18 and the seat cover 20 from the toilet fixture 12. Long bolts 34 and 38 then replace the short bolts, pass through the seating mounting assembly 16, pass through the seat mounting passages 54 and 56 through the mounting lift block 44 and through the vertical seat mounting passages 28 and 30 in the fixture 12. A nut 35 is received on each bolt 34 and 38 under the bowl rim 26 and behind the bowl portion 24. Bolts 34 and 38 are then tightened to secure the toilet seat 18 in place.

The lift blocks 46, 47 and 48 are secured to the seat 18 as disclosed above and the toilet 10 is ready for use with the seat in a raised horizontal position.

The mounting lift block 44 and the lift blocks 46, 47 and 48 as shown in the drawing figures are molded hollow plastic members with reinforcing ribs 70 and 72. The mounting lift block 44 and the lift blocks 46, 47 and 48 could also be solid plastic members. Hollow molded blocks weigh substantially less than solid plastic blocks. Three lift blocks 46, 47 and 48 provide adequate support for the seat 18. However, the number of lift blocks 46, 47 and 48 can be changed if desired. The front center lift block 47 also functions as a spray guard. Recesses 74 in the top of the lift blocks 46, 47 and 48 straddle seat support pads on the bottom surface 62 of the toilet seat 18 if such pads are employed on the seat. It may be necessary to increase the vertical height of the lift blocks 46, 47 and 48 by the height of straddled seat support pads to keep the toilet seat 18 horizontal.

The vertical height of the seat mounting lift block 44 and the seat lift blocks 46, 47 and 48 is preferably two inches. However, the height can be varied. The seat mounting lift block 44 provides stability for the toilet seat 18 and can accommodate a range of vertical heights.

Obviously, many modifications and variation of the present invention are possible in light of the above teachings. It is, therefore, to be understood that within the scope of the appended claims, the invention may be practiced otherwise than as specifically described. The invention is defined by the claims.

What is claimed is:

1. A method of raising a toilet seat for use by a challenged individual, above a bowl rim of a toilet fixture comprising:

removing two bolts that secure a seat mounting assembly, the toilet seat and a toilet seat cover from the toilet fixture;

positioning a toilet seat mounting lift block on top of the bowl rim of the toilet fixture with a left vertical seat mounting passage through said toilet seat mounting lift block and a right vertical seat mounting passage through said toilet seat mounting lift block in vertical alignment with a pair of toilet fixture seat mounting passages;

inserting a first elongated fastener through a left bracket of the seat mounting assembly, through the left vertical seat mounting passage and one of the pair of toilet fixture mounting passages;

inserting a second elongated fastener through a right bracket of the seat mounting assembly, through the right vertical seat mounting passage and the other one of the pair of toilet fixture mounting passages;

tightening the first and second elongated fasteners to hold the seat mounting assembly in a raised position about the bowl rim of the toilet fixture; and attaching at least one lift block to a seat bottom surface of the toilet seat to hold the toilet seat in a generally horizontal position when the at least one lift block is in contact with the bowl rim.

2. A method of raising a toilet seat as set forth in claim 1 wherein the step of attaching at least one lift block includes attaching a second lift block to the seat bottom surface.

3. A method of raising a toilet seat as set forth in claim 1 including attaching a spray guard to the seat bottom surface of the toilet seat.

* * * * *